US008672708B2

(12) United States Patent
Ritter et al.

(10) Patent No.: US 8,672,708 B2
(45) Date of Patent: Mar. 18, 2014

(54) CONNECTOR ASSEMBLY HAVING A FLOATABLE MODULE ASSEMBLY WITH A COUPLING MEMBER

(75) Inventors: Christopher D. Ritter, Hummelstown, PA (US); Jeffrey Simpson, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 52 days.

(21) Appl. No.: 13/544,038

(22) Filed: Jul. 9, 2012

(65) Prior Publication Data

US 2014/0011396 A1 Jan. 9, 2014

(51) Int. Cl.
*H01R 13/648* (2006.01)
*H01R 13/64* (2006.01)

(52) U.S. Cl.
USPC ..... 439/541.5; 439/247

(58) Field of Classification Search
USPC ..... 439/226–244, 350–352, 247–248, 439/541.5, 544–546
See application file for complete search history.

(56) References Cited

U.S. PATENT DOCUMENTS

| | | | | |
|---|---|---|---|---|
| 5,037,330 | A * | 8/1991 | Fulponi et al. | 439/607.23 |
| 5,167,531 | A * | 12/1992 | Broschard et al. | 439/541.5 |
| 6,135,797 | A * | 10/2000 | McCleerey et al. | 439/248 |
| 6,213,813 | B1 * | 4/2001 | Huang | 439/607.01 |
| 6,976,870 | B1 * | 12/2005 | Li | 439/541.5 |
| 7,137,847 | B2 * | 11/2006 | Trout et al. | 439/465 |
| 7,878,829 | B2 * | 2/2011 | Yang et al. | 439/247 |
| 7,922,539 | B2 * | 4/2011 | Kubo | 439/620.21 |
| 8,439,702 | B2 * | 5/2013 | Dietz et al. | 439/545 |
| 2005/0032406 | A1 * | 2/2005 | Shiota et al. | 439/247 |

* cited by examiner

*Primary Examiner* — Chandrika Prasad

(57) ABSTRACT

A connector assembly including a support frame and a module assembly that is movably coupled to the support frame. The module assembly includes first and second connector modules that are positioned adjacent to each other and a coupling member that joins the first and second connector modules. Each of the first and second connector modules is configured to mate with a mating connector along a corresponding mating axis to establish a communicative connection. The coupling member joins the first and second connector modules such that the first and second connector modules move with each other and relative to the support frame. The coupling member permits the first and second connector modules to move relative to each other when the mating connectors engage the first and second connector modules.

20 Claims, 5 Drawing Sheets

CONNECTOR ASSEMBLY HAVING A FLOATABLE MODULE ASSEMBLY WITH A COUPLING MEMBER

BACKGROUND OF THE INVENTION

The subject matter herein relates generally to connector assemblies configured to at least one of electrically or optically connect different communication systems.

Connector assemblies, such as those used in networking and telecommunication systems, may utilize receptacle and header modules (also referred to as connectors or connector modules) to interconnect components of the system, such as a motherboard and daughtercard. The connector modules may include alignment features that facilitate aligning the connector modules as the connector modules engage each other during a mating operation. For example, a first electrical connector may have inclined surfaces that direct a second electrical connector into alignment with the first electrical connector.

However, there is a desire in the industry to increase the density of signal lines (e.g., electrical or optical pathways) without an appreciable increase in size of the connector modules. In fact, a decrease in the sizes of the connector modules is desired. But increasing the density of signal lines and/or reducing the size of the connector modules may limit an amount or degree of misalignment that the connector modules can accommodate during a mating operation. As such, it may be more challenging to align and mate the connector modules. The difficulty may be amplified when, for example, a number of connector modules on a daughtercard are simultaneously mated with a number of mating connectors on a motherboard. In this example, if one improperly oriented connector module is unable to engage the corresponding mating connector, the remaining connector modules may be prevented from mating with the corresponding mating connectors.

Accordingly, there is a need for a connector assembly that facilitates aligning a plurality of connector modules with corresponding mating connectors during a mating operation.

BRIEF DESCRIPTION OF THE INVENTION

In one embodiment, a connector assembly is provided that includes a support frame and a floatable module assembly that is movably coupled to the support frame. The module assembly includes first and second connector modules that are positioned adjacent to each other and a coupling member that joins the first and second connector modules. Each of the first and second connector modules is configured to mate with a corresponding mating connector along a mating axis to establish a communicative connection. The coupling member joins the first and second connector modules such that the first and second connector modules move with each other and relative to the support frame. The coupling member permits the first and second connector modules to move relative to each other when the corresponding mating connectors engage the first and second connector modules.

In one embodiment, a connector assembly is provided that includes a support frame and a floatable module assembly that is movably coupled to the support frame. The module assembly includes first and second connector modules that are positioned adjacent to each other and a coupling member that joins the first and second connector modules. Each of the first and second connector modules is configured to mate with a corresponding mating connector along a mating axis to establish a communicative connection. The coupling member has a tension that holds the first and second connector modules adjacent to each other when the first and second connector modules are in unmated positions. The coupling member permits the first and second connector modules to move relative to each other when alignment forces provided by the corresponding mating connectors displace the first and second connector modules.

DETAILED DESCRIPTION OF THE INVENTION

Figure 1:
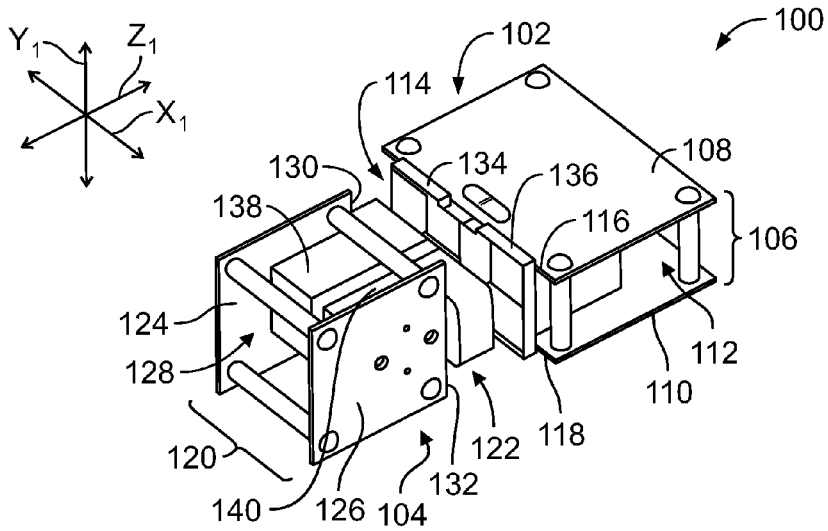
FIG. 1 is a perspective view of a connector system including a connector assembly formed in accordance with one embodiment.

FIG. 1 is a perspective view a connector system 100 formed in accordance with one embodiment. The connector system 100 is oriented with respect to mutually perpendicular axes $X_1$-, $Y_1$, and $Z_1$-axes. The connector system 100 includes first and second connector assemblies 102, 104. The connector assembly 102 includes a support frame 106 that supports at least one floatable module assembly 114. In the illustrated embodiment, the support frame 106 includes assembly plates (or panels) 108, 110 that are spaced apart from each other and extend parallel to a plane defined by the $Z_1$-axis and the $X_1$-axis. The assembly plates 108, 110 define a module-receiving gap or space 112 therebetween. The module assembly 114 may be positioned at least partially in the module-receiving gap 112. As shown in FIG. 1, the module assembly 114 clears front edges 116, 118 of the assembly plates 108, 110, respectively.

Likewise, the connector assembly 104 includes a support frame 120 that supports a module assembly 122. In the illustrated embodiment, the support frame 120 includes assembly plates (or panels) 124, 126 that are spaced apart from each other and extend parallel to a plane defined by the $Z_1$-axis and the $Y_1$-axis. As such, the assembly plates 124, 126 of the support frame 120 are characterized as being orthogonal to the assembly plates 108, 110 of the support frame 106. The assembly plates 124, 126 define a module-receiving gap or space 128 therebetween. The module assembly 122 may be positioned at least partially in the module-receiving gap 128. The module assembly 122 clears front edges 130, 132 of the assembly plates 124, 126, respectively.

The module assembly 114 includes a pair of connector modules 134, 136, and the module assembly 122 includes a pair of connector modules 138, 140. As shown in FIG. 1, the connector modules 134, 136, 138, 140 are laterally aligned along the $X_1$-axis. The connector modules 134, 136 are configured to mate with the connector modules 138, 140, respectively, to establish a communicative connection (e.g., at least one of an electrical or optical connection).

As will be described in greater detail below, the connector modules 134, 136 are coupled to each other such that the connector modules 134, 136 may move as a unit relative to the support frame 106, but may also move with respect to each other. In such embodiments in which the connector modules 138, 140 have fixed positions relative to the assembly plates 124, 126, the connector modules 134, 136 may move relative to the support frame 106. The connector modules 134, 136 may also move relative to each other so that the connector module 134 is operatively aligned with the connector module 138 and so that the connector module 136 is operatively aligned with the connector module 140. As the connector assemblies 102, 104 are engaged, the connector modules 134, 136 may adjust to different orientations with respect to the support frame 106.

However, the connector assemblies 102, 104 are not limited to the embodiment shown in FIG. 1. For example, the connector modules 138, 140 of the connector assembly 104 are not required to have rigid or affixed positions. In other embodiments, the connector modules 138, 140 may be movable with respect to the support frame 120 and movable with respect to each other. Moreover, the connector assemblies 102, 104 may have other modifications. For example, the connector assemblies 102, 104 may include one or more circuit boards instead of the respective plates.

Figure 2:
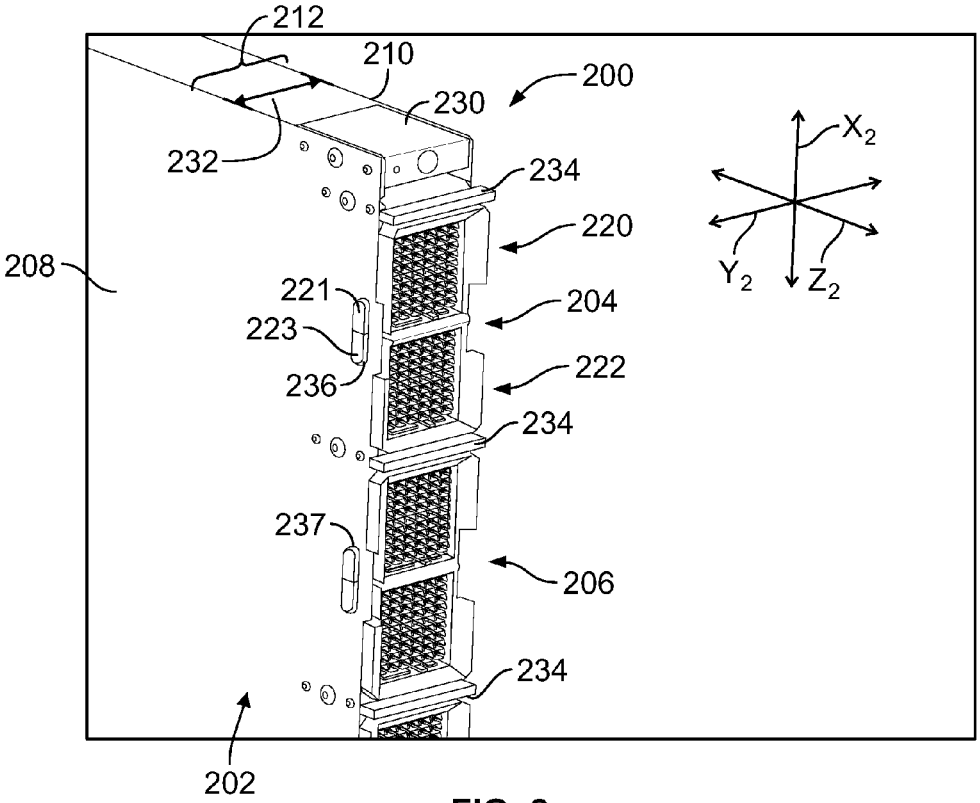
FIG. 2 is a perspective view of a connector assembly formed in accordance with one embodiment.

FIG. 2 is a perspective view of a connector assembly 200 formed in accordance with one embodiment. The connector assembly 200 is oriented with respect to mutually perpendicular $X_2$-, $Y_2$-, and $Z_2$-axes. The connector assembly 200 may be similar to the connector assembly 102 (FIG. 1) and used in a connector system, such as the connector system 100 (FIG. 1). For example, the connector assembly 200 may include a support frame 202. The support frame 202 is configured to hold one or more module assemblies, such as module assemblies 204, 206 shown in FIG. 2. The module assemblies 204, 206 are movably coupled to the support frame 202. In the illustrated embodiment, gravity extends in a direction along the $X_2$-axis and, as such, the connector assembly 200 is oriented in an upright, vertical orientation. Alternatively, the connector assembly 200 may have other orientations, such as a horizontal orientation.

The support frame 202 includes assembly plates (or panels) 208, 210 that are spaced apart from each other and extend parallel to a plane defined by the $X_2$-axis and the $Z_2$-axis. The assembly plates 208, 210 define a module-receiving gap or space 212 therebetween. The module assemblies 204, 206 are positioned at least partially in the module-receiving gap 212. The assembly plate 208 includes feature openings 236, 237. The feature openings 236 extend completely through the assembly plate 208. Although not shown, the assembly plate 210 may have feature openings that are similar to the feature openings 236, 237.

The connector assembly 200 may include at least one spacer 230 that extends between and joins the assembly plates 208, 210. The spacer 230 holds the assembly plates 208, 210 at a separation distance 232. In the illustrated embodiment, the connector assembly 200 also includes at least one separator wall 234 that is disposed between adjacent module assemblies, such as the module assemblies 204, 206. The separator walls 234 may comprise a conductive material that shields the module assemblies 204, 206 from crosstalk or electromagnetic interference.

Although the following description applies particularly to the module assembly 204, the module assembly 206 (and other modules assemblies of the connector assembly 200 that are not shown in FIG. 2) may include similar or identical features and elements. The module assembly 204 includes first and second connector modules 220, 222 having first and second structural features 221, 223, respectively. The feature opening 236 is sized and shaped to receive the structural features 221, 223. The structural features 221, 223 are sized and shaped relative to the corresponding feature opening 236 so that the structural features 221, 223 are permitted to move a designated distance along the $X_2$-axis. Each of the first and second connector modules 220, 222 is configured to mate with a corresponding mating connector (not shown) along the $Z_2$-axis to establish at least one of an electrical or optical connection. The mating connectors may be similar to the connector modules 138, 140 shown in FIG. 1.

In the illustrated embodiment, the connector modules 220, 222 are electrical connectors including differential pairs of signal conductors. The connector modules 220, 222 may be configured to transmit high-speed differential signals. For example, each of the connector modules 220, 222 may be similar to a STRADA Whisper® connector developed by Tyco Electronics. In some embodiments, the high-speed signals are transmitted at 25 Gbps or more. Although the connector assembly 200 is described with particular reference to high speed, differential-type systems, it is understood that embodiments described herein may be applicable to other types of electrical connectors and, in particular, electrical connectors that include differential pairs. Embodiments described herein may also be applicable in connector systems that include optical connectors or opto-electronic connectors.

Figure 3:
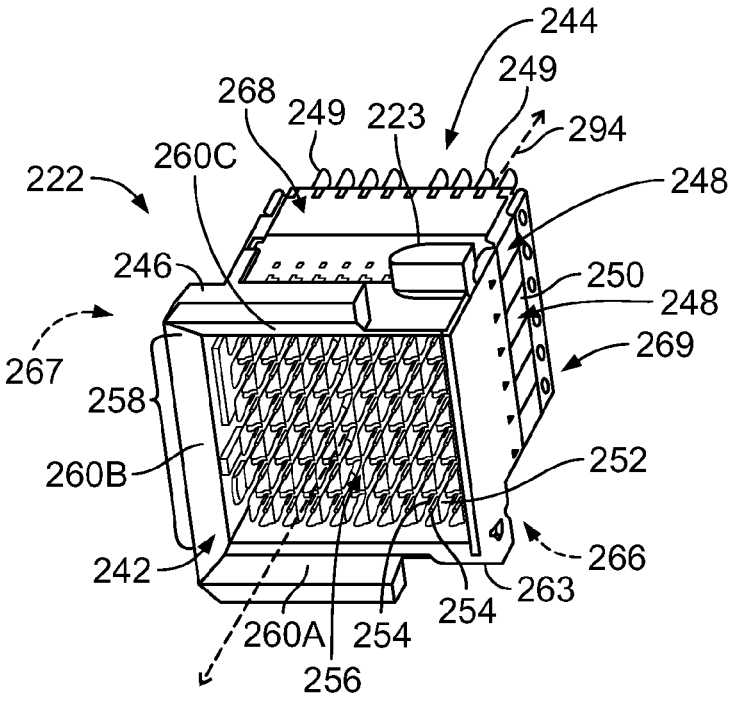
FIG. 3 is an isolated perspective view of a connector module that may be used with the connector assembly of FIG. 2.

FIG. 3 is an isolated perspective view of the connector module 222. The connector module 220 (FIG. 2) may have similar or identical features. The connector module 222 is oriented relative to a central mating axis 294, which may extend substantially parallel to the $Z_2$-axis (FIG. 2) during operation. The connector module 222 has a mating face 242 and a loading side or end 244 that face in opposite directions along the mating axis 294. The mating face 242 is configured to engage and mate with the corresponding mating connector (not shown). As shown, the connector module 222 includes a connector housing or body 246 and contact modules 248 that are operatively coupled to the connector housing 246. Each of the contact modules 248 may include a leadframe (not shown) comprising a plurality of conductors (not shown) and a dielectric body 250 that holds the leadframe.

The connector housing 246 is configured to receive portions or sections of the contact modules 248 and hold the contact modules 248 in fixed positions with respect to one another. The contact modules 248 can be stacked side-by-side along the $Y_2$-axis (FIG. 2). The contact modules 248 include electrical contacts 252, 254 that constitute an array of the electrical contacts 252, 254 that are disposed at the mating face 242.

The electrical contacts 252, 254 may be configured to mechanically and electrically engage corresponding contacts (not shown) of the mating connector. The electrical contacts may include ground contacts 252 and signal contacts 254. In the illustrated embodiment, the signal contacts 254 are pin contacts and the ground contacts 252 include C-shaped contacts in which each C-shaped contact surrounds a pair of the signal contacts 254. However, other types of contacts may be used and have different configurations in alternative embodiments.

In the illustrated embodiment, the connector module 222 includes a plurality of communication cables 249 that are communicatively engaged to the contact modules 248 at the loading end 244. Each of the communication cables 249 may include a pair of signal conductors and at least one ground conductor. The signal conductors may define a twisted-pair of conductors. The signal conductors are electrically coupled to the signal contacts 254, and the ground conductor(s) is electrically coupled to the ground contacts 252.

The connector housing 246 defines a housing cavity 256 that opens along the mating face 242. The ground and signal contacts 252, 254 are disposed in the housing cavity 256. The connector housing 246 may define an opening 258 to the housing cavity 256. The connector housing 246 may also include alignment features 260A-260C. The alignment features 260A-260C may be surfaces that are angled with respect to the mating axis 294 and configured to direct the mating connector into an aligned position with respect to the connector module 222. More specifically, when the mating connector and the connector module 222 are misaligned prior to mating, the alignment features 260A-260C may engage the mating connector and direct the mating connector into an aligned position during the mating operation. Although the alignment features 260A-260C are angled surfaces in the illustrated embodiment, various other alignment features may be used.

The connector housing 246 has a plurality of connector sides 266-269. The connector sides 266-269 extend along the mating axis 294 between the mating face 242 and the loading end 244. In the illustrated embodiment, each of the connector sides 266-269 includes a portion of the housing 246 and a portion of one or more of the contact modules 248. The connector sides 266-269 face radially away from the mating axis 294. The connector sides 266-268 may be referred to as exterior sides and the connector side 269 may be referred to as an interior side 269. The interior side 269 is configured to abut another connector side (not shown) of the connector module 220 (FIG. 2) as described below.

Also shown in FIG. 3, the structural feature 223 is coupled to and projects away from the connector side 268. The connector module 222 may also include another structural feature 263, which is coupled to and projects away from the connector side 266. As such, the structural features 223, 263 are located on opposite connector sides 268, 266 and project in opposite directions.

Figure 4:
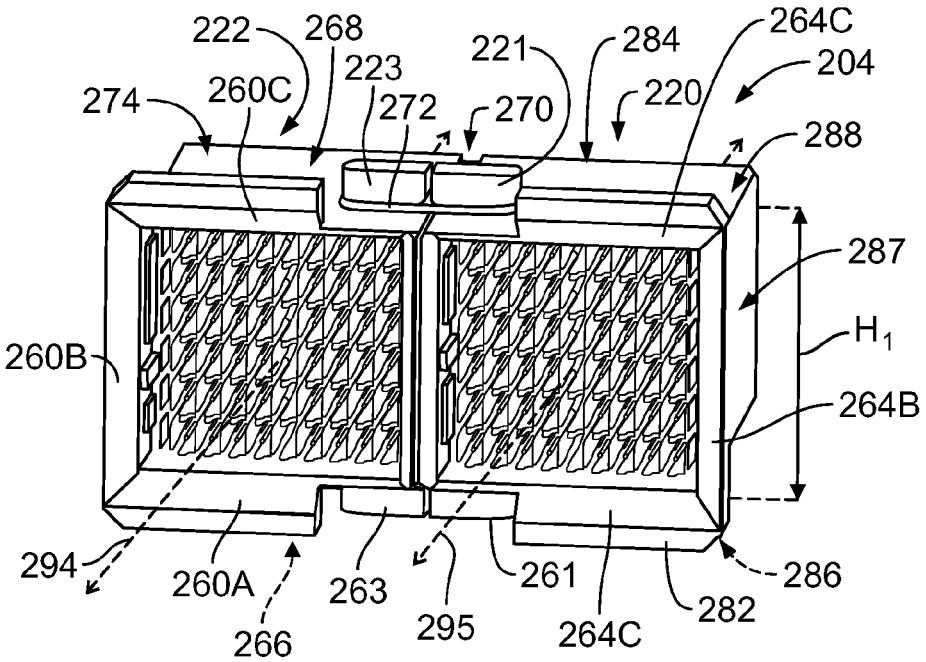
FIG. 4 is an isolated perspective view of a module assembly that may be used with the connector assembly of FIG. 2.

FIG. 4 is an isolated perspective view of the module assembly 204 including the connector modules 220, 222. The connector module 220 includes similar features and elements as described above with respect to the connector module 222. For example, the connector module 220 includes a connector housing 282 having connector sides 286-288 that face radially away from a mating axis 295 of the connector module 220. The mating axis 295 may extend parallel to the mating axis 294 of the connector module 222. Although not shown, the connector module 220 may also include an interior side that is similar to the interior side 269 (FIG. 3).

When the module assembly 204 is assembled, the connector modules 220, 222 are positioned adjacent to each other such that the interior side 269 (FIG. 3) of the connector module 222 and the interior side (not shown) of the connector module 220 are positioned adjacent to each other along an interface 270. The connector modules 220, 222 may be adjacent to each other when a distance between the interior sides does not exceed 1 cm when the connector modules 220, 222 are engaged to the corresponding mating connectors (not shown). In more particular embodiments, the distance does not exceed 5.0 mm or 2.0 mm. However, in other embodiments the distance may be greater than 1.0 cm. Also, in the illustrated embodiment, the module assembly 204 does not include any intervening components that are located between the connector modules 220, 222. However, in other embodiments, spacers or thin shields, similar to the separator walls 234 (FIG. 2), may be positioned between the connector modules 220, 222.

The module assembly 204 may also include one or more coupling members 272 that join the connector modules 220, 222. The coupling members 272 may be configured to join the connector modules 220, 222 such that the connector modules 220, 222 have substantially fixed positions with respect to each other when the connector modules 220, 222 are not mated to the mating connectors. The coupling member 272 may engage each of the connector modules 220, 222. For example, the connector modules 220, 222 may be permitted to move together as a unit relative to the support frame 202 (FIG. 2) during the mating operation.

However, the coupling member 272 may also permit the connector modules 220, 222 to move relative to each other during the mating operation. More specifically, during the mating operation, the mating connectors may engage the connector modules 220, 222 and provide alignment forces (described in greater detail below) that are greater than an ability of the coupling member(s) 272 to hold the connector modules 220, 222 together as a unit. The alignment forces may cause the connector modules 220, 222 to move relative to each other and the support frame 202.

One example of a coupling member 272 includes an elastic member that is configured to flex. In the illustrated embodiment, the coupling member 272 includes a loop that comprises a flexible material. The loop surrounds and grips each of the structural features 221, 223 of the connector modules 220, 222, respectively. Although not shown, a coupling member similar to the coupling member 272 may engage the connector modules 220, 222 along the connector sides 266, 286, respectively. This coupling member may also be a loop that surrounds and grips the structural feature 263 of the connector module 222 and a structural feature 261 of the connector module 220.

In alternative embodiments, a coupling member may be a flexible plug or joint that couples to each of the connector modules 220, 222. For example, a plug may extend through the interior side 269 (FIG. 3) and through the interior side (not shown) of the connector module 220 and grip the connector modules 220, 222. The plug may permit the connector modules 220, 222 to move relative to each other. As another example, a coupling member may include a plurality of flexible fingers that extend from the interior sides of the connector modules 220, 222. The flexible fingers may be molded from the housing material of the connector housings 246, 282 or the flexible fingers may be separate parts that are attached to the connector housings 246, 282. In such embodiments, the flexible finger(s) extending from the interior side of the connector module 220 may engage the connector module 222. Likewise, the flexible finger(s) extending from the interior side 269 of the connector module 222 may engage the connector module 220. Collectively, the plurality of flexible fingers may hold the connector modules 220, 222 together while permitting some movement with respect to each other.

Similar to the alignment features 260A-260C of the connector module 222, the connector module 220 may also have alignment features 264A-264C. The alignment features 260A-260C and 264A-264C may collectively operate to align a pair of the mating connectors (not shown) with the connector modules 222, 220. As shown in FIG. 4, the module assembly 204 does not include alignment features extending along the interior sides that define the interface 270. In such embodiments, the connector modules 220, 222 may be positioned closer together and a higher density of signal lines may be achieved.

Also shown in FIG. 4, the connector side 268 of the connector module 222 has a base surface 274, and the connector side 288 of the connector module 220 has a base surface 284. The base surfaces 274, 284 may extend along a common plane and face in a substantially common direction. The alignment feature 260C and the structural feature 223 project away from the base surface 274, and the alignment feature 264C and the structural feature 221 project away from the base surface 284. Although not shown, the connector side 266 of the connector module 222 and the connector side 286 of the connector module 220 may also have corresponding base surfaces.

Each of the connector modules 220, 222 may have a common height $H_1$ that is measured between the corresponding base surfaces of the corresponding connector module. More specifically, the height $H_1$ of the connector module 222 extends from the base surface 274 to the base surface (not shown) of the connector side 266. The height $H_1$ of the connector module 220 extends from the base surface 284 to the base surface (not shown) of the connector side 286. The height $H_1$ is configured to be less than the separation distance 232 so that the module assembly 204 and the connector modules 220, 222 are permitted to move along the $Y_2$-axis (FIG. 2).

Figure 5:
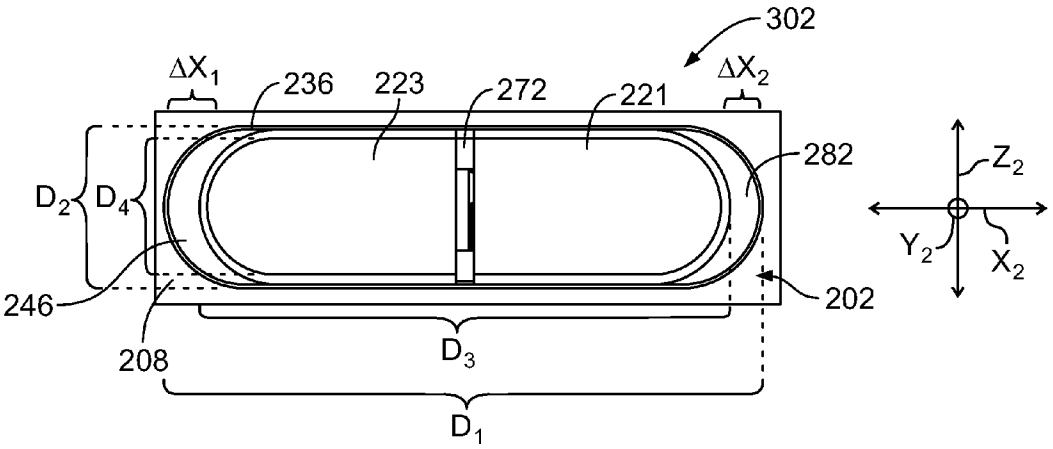
FIG. 5 is a plan view of a floating mechanism that is utilized by the connector assembly of FIG. 2.
Figure 6:
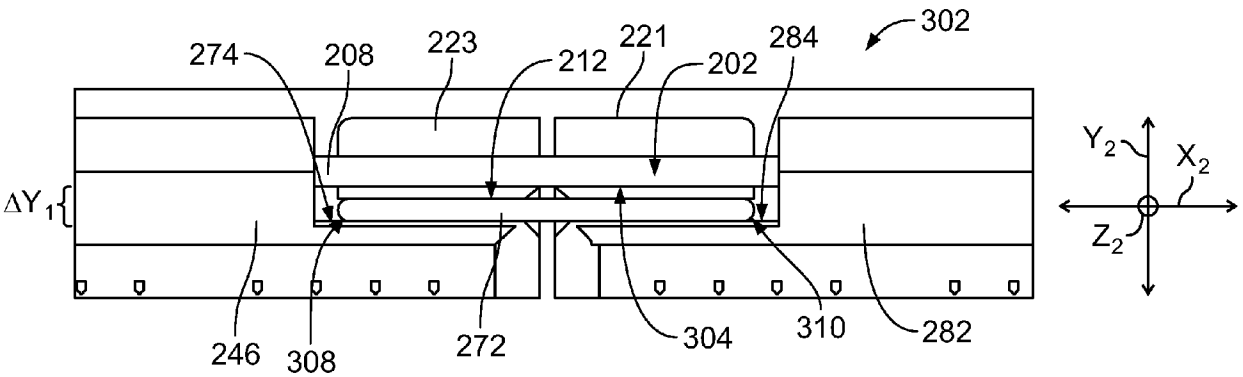
FIG. 6 is a front view of the floating mechanism of the connector assembly of FIG. 2.

FIGS. 5 and 6 show enlarged portions of the connector assembly 200 (FIG. 2). More specifically, FIG. 5 is a plan view of a floating mechanism 302 that is used by the connector assembly 200, and FIG. 6 is a front view of the floating mechanism 302. In the illustrated embodiment, the floating mechanism 302 includes the assembly plate 208, the connector housings 246, 282, and the coupling member 272. The assembly plate 208 and the connector housings 246, 282 are sized and shaped relative to each other to permit the module assembly 204 (FIG. 4) to float along a plane defined by the $X_2$- and $Y_2$-axes. For example, the floating mechanism 302 may permit the module assembly 204 to float in one or more directions that are orthogonal to the mating axes 294 (FIG. 3), 295 (FIG. 4). In some embodiments, the floating mechanism 302 may also permit the module assembly 204 to float in a direction along the $Z_2$-axis. The floating (or movement) of the module assembly 204 is relative to the support frame 202.

As shown in FIG. 5, the feature opening 236 has first and second opening dimensions $D_1$ and $D_2$. The first opening dimension $D_1$ extends along the $X_2$-axis, and the second opening dimension $D_2$ extends along the $Z_2$-axis. The structural features 223, 221 are positioned adjacent to each other and collectively have a first feature dimension $D_3$ that extends along the $X_2$-axis and a second feature dimension $D_4$ that extends along the $Z_2$-axis. As shown, the structural features 223, 221 are sized and shaped to be inserted through the feature opening 236. The first opening dimension $D_1$ is greater than the first feature dimension $D_3$ to allow the structural features 223, 221 and, thus, the module assembly 204 (FIG. 4) to move along the $X_2$-axis. As shown, the module assembly 204 may move a distance $\Delta X_1$ in one direction along the $X_2$-axis and a distance $\Delta X_2$ in the opposite direction along the $X_2$" axis. In the illustrated embodiment, the second opening dimension $D_2$ is slightly greater than the second feature dimension $D_4$ to allow nominal movement along the $Z_2$-axis. However, in other embodiments, the second opening dimension $D_2$ may be substantially greater than the second feature dimension $D_4$ to allow more movement along the $Z_2$-axis.

Turning to FIG. 6, the base surfaces 274, 284 are configured to be disposed in the module-receiving gap 212 and face an interior surface 304 of the assembly plate 208. As described above, the connector housings 246, 282 may be dimensioned to permit the connector housings 246, 282 to float relative to the support frame 202. For example, the height $H_1$ (FIG. 4) may be less than the separation distance 232. In such cases, a distance $\Delta Y_1$ may exist between the base surfaces 274, 284 and the interior surface 304. Accordingly, the module assembly 204 is permitted to float along the $Y_2$-axis.

Also shown in FIG. 6, each of the structural features 223, 221 may define a channel or groove 308, 310, respectively, that is configured to receive a portion of the coupling member 272. For example, the channels 308, 310 may be proximate to the base surfaces 274, 284, respectively, and extend along the plane defined by the $X_2$- and $Z_2$-axes. The grooves 308, 310 receive the coupling member 272 so that the coupling member 272 is not compressed between the connector housings 246, 282 and the assembly plate 208 and so that the connector housings 246, 282 may float freely in the module-receiving gap 212. However, in alternative embodiments, the coupling member 272 may be permitted to engage the assembly plate 208. For example, the coupling member 272 may be compressed between the interior surface 304 and the base surfaces 274, 284.

Although not shown, the connector housings 246, 282 may be separated from the assembly plate 210 (FIG. 2) by a distance that provides space for the module assembly 204 to float along the $Y_2$-axis. Also not shown, the connector assembly 200 (FIG. 2) may include at least one other floating mechanism that is similar to the floating mechanism 302. For instance, the floating mechanism may exist along the assembly plate 210 and include the structural features 263, 261 (FIG. 4).

Figure 7:
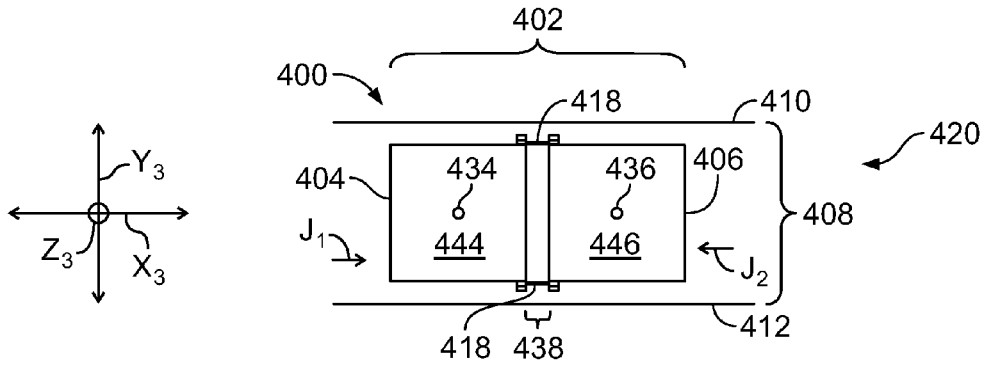
FIG. 7 illustrates a connector assembly at a first stage of a mating operation in accordance with one embodiment.
Figure 8:
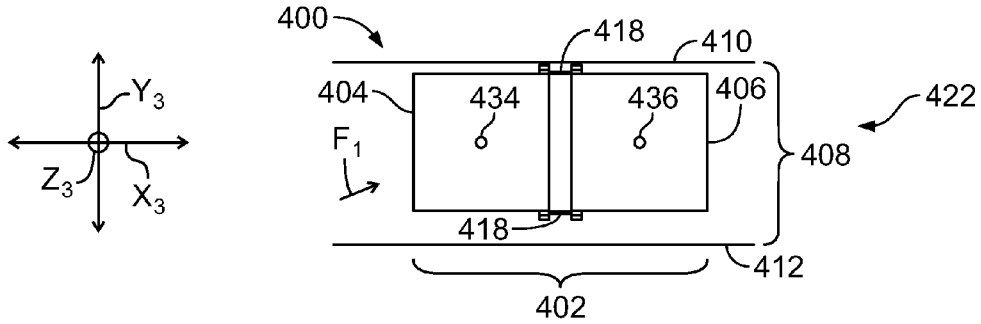
FIG. 8 illustrates the connector assembly at a second stage of the mating operation in which the connector assembly has been initially engaged by mating connectors.
Figure 9:
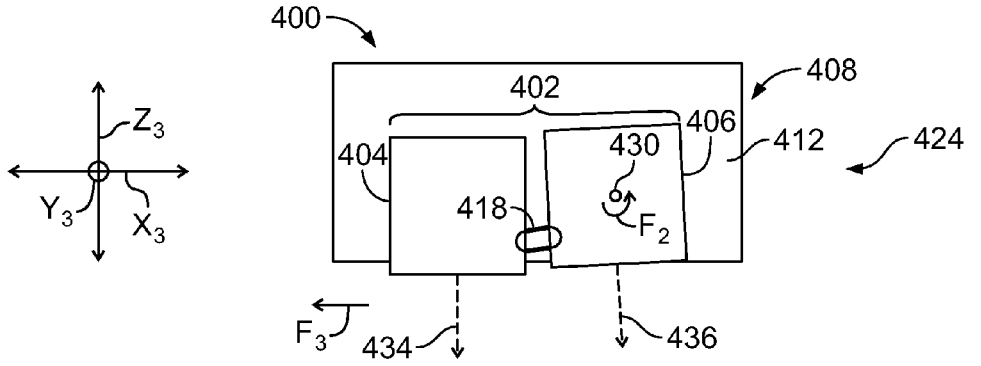
FIG. 9 illustrates the connector assembly at a third stage of the mating operation in which the connector assembly is mated to the mating connectors.

FIGS. 7-9 show a connector assembly 400 at different stages 420, 422, 424 of a mating operation. The connector assembly 400 may be similar to the connector assembly 200 (FIG. 2). For example, the connector assembly 400 includes a module assembly 402 having first and second connector modules 404, 406 and a support frame 408 having first and second assembly plates 410, 412. (The assembly plate 410 is not shown in FIG. 9.) In particular, FIGS. 7-9 illustrate how the module assembly 402 is permitted to move relative to the support frame 408 and how the connector modules 404, 406 are permitted move to relative to each other. The connector assembly 200 operates in a similar manner. In FIGS. 7 and 8, the stages 420 and 422 are shown with respect to the same front view of the connector assembly 400. In FIG. 9, the stage 424 is shown relative to a plan view in which the assembly plate 410 has been removed. Each of the stages 420, 422, 424 is shown with respect to mutually perpendicular $X_3$-, $Y_3$-, and $Z_3$-axes.

With respect to FIG. 7, the stage 420 shows the module assembly 402 in an unmated state prior to engagement. The connector modules 404, 406 are configured to mate with mating connectors (not shown) of another connector assembly or system (not shown). When the connector modules 404, 406 are not mated to the mating connectors, the connector modules 404, 406 have unengaged or unmated positions and are held adjacent to each other by coupling members 418. A separation distance 438 may exist between the connector modules 404, 406. Alternatively, the separation distance 438 does not exist at the stage 420 and the connector modules 404, 406 directly abut each other. The connector modules 404, 406 have mating faces 444, 446, respectively, that face in directions along respective mating axes 434, 436. The mating axes 434, 436 may extend parallel to the $Z_3$-axis and to each other.

In an exemplary embodiment, each of the coupling members 418 has a stored or working tension. The tensions may collectively provide joining forces $J_1$ and $J_2$ to hold the connector modules 404, 406 adjacent to each other. However, the joining forces $J_1$ and $J_2$ are only representative of at least some of the forces that may be provided by the coupling members 418. For example, when the coupling members 418 are elastic members, such as the loop of the coupling member 272 described above, the coupling members 418 may resist movement of the connector modules 404, 406 in various directions that are away from the unengaged positions shown in FIG. 7.

At the unengaged state, the coupling members 418 may not be tense (e.g., providing a joining force(s) to hold the connector modules 404, 406 together). In such embodiments, the joining forces $J_1$ and $J_2$ may only be applied if the connector modules 404, 406 move from the unengaged positions. More specifically, in some embodiments, the connector modules 404, 406 may be permitted to move freely without resistance by the coupling members 418 up to the separation distance 438 between the connector modules 404, 406. The coupling members 418 may permit further separation beyond the designated separation distance 438 but only if the alignment forces exceed the tensions of the coupling members 418. In some embodiments, the connector modules 404, 406 are permitted to move with resistance by the coupling members 418 up to a maximum separation distance between the connector modules 404, 406. In such embodiments, the coupling members 418 restrict further separation beyond the maximum separation distance.

In other embodiments, the coupling members 418 may be tense such that the joining forces $J_1$ and $J_2$ are actively applied to the connector modules 404, 406 in the unengaged state. In such embodiments, the connector modules 404, 406 may directly engage each other. During a mating operation, the coupling members 418 may permit the connector modules 404, 406 to move, with resistance, away from the unengaged positions to a maximum separation distance between the connector modules 404, 406.

With respect to FIG. 8, as the mating connectors initially engage the connector modules 404, 406, one or more of the mating connectors may engage the respective connector module in a misaligned manner. When engaged in a misaligned manner, the mating connector may provide an alignment force, such as the alignment force $F_1$. The alignment force $F_1$ may overcome any static or frictional forces that maintain the connector modules 404, 406 in the unengaged positions and move the module assembly 402 as shown in FIG. 8. However, the alignment force $F_1$ may not overcome the tension provided by the coupling members 418 (e.g., the joining forces $J_1$ and $J_2$ that hold the connector modules 404, 406 in position with respect to each other). As such, the coupling members 418 substantially maintain positions of the connector modules 404, 406 relative to each other while the connector modules 404, 406 are moved together with respect to the support frame 408. The module assembly 402 may move as a unit relative to the support frame 408.

Turning to FIG. 9, as the mating connectors continue to approach and engage the connector modules 404, 406, the mating connectors may provide separate alignment forces to the respective connector modules 404, 406. For example, in some cases, the mating connectors may be rigidly secured to plates or circuit boards (not shown). However, due to tolerances in the manufacturing process, the mating connectors may not be precisely oriented. As such, when the mating connectors engage the connector modules 404, 406, the mating connectors may provide different alignment forces. The different alignment forces may displace and move the connector modules 404, 406 in different manners.

As one example, the mating connector that engages the connector module 406 may provide a rotational force $F_2$ that causes the connector module 406 to rotate about an axis 430 that extends parallel to the $Y_3$-axis. The mating connector that engages the connector module 404 may provide a separation force $F_3$ that shifts the connector module 404 away from the connector module 406. Thus, the coupling members 418 permit the connector modules 404, 406 to move relative to each other when the mating connectors engage the connector modules 404, 406. In some embodiments, the coupling members 418 permit the connector modules 404, 406 to be oriented such that the mating axes 434, 436, respectively, extend non-parallel to each other as shown in FIG. 9.

Accordingly, in some embodiments, the connector assembly 400 may be configured to undergo different mating stages. The stage 422 shown in FIG. 8 may be a gross-alignment stage 422 in which the connector modules 404, 406 are moved in a common direction and for a common distance to approximately align the corresponding mating connectors and connector modules. The stage 424 shown in FIG. 9 may be a secondary-alignment stage 424 in which the connector modules 404, 406 are moved to respective orientations, which may be different, to mate with the corresponding mating connectors.

It is understood that the above is just one example of the movement that the coupling members 418 may permit. Other types of movements may be permitted by the coupling members 418. For example, with respect to FIG. 8, the coupling members 418 may permit the connector module 406 to rotate about the mating axis 436. The coupling members 418 may also permit the connector modules 404, 406 to move away from each other along the $X_3$-axis. The coupling members 418 may also permit the connector modules 404, 406 to move in different directions along the $Y_3$-axis. It is also understood that the connector modules 404, 406 may move in a combination of ways. For instance, the connector module 406 may rotate about the mating axis 436, shift in one direction along the $Y_3$-axis, and shift in one direction along the $X_3$-axis.

Figure 10:
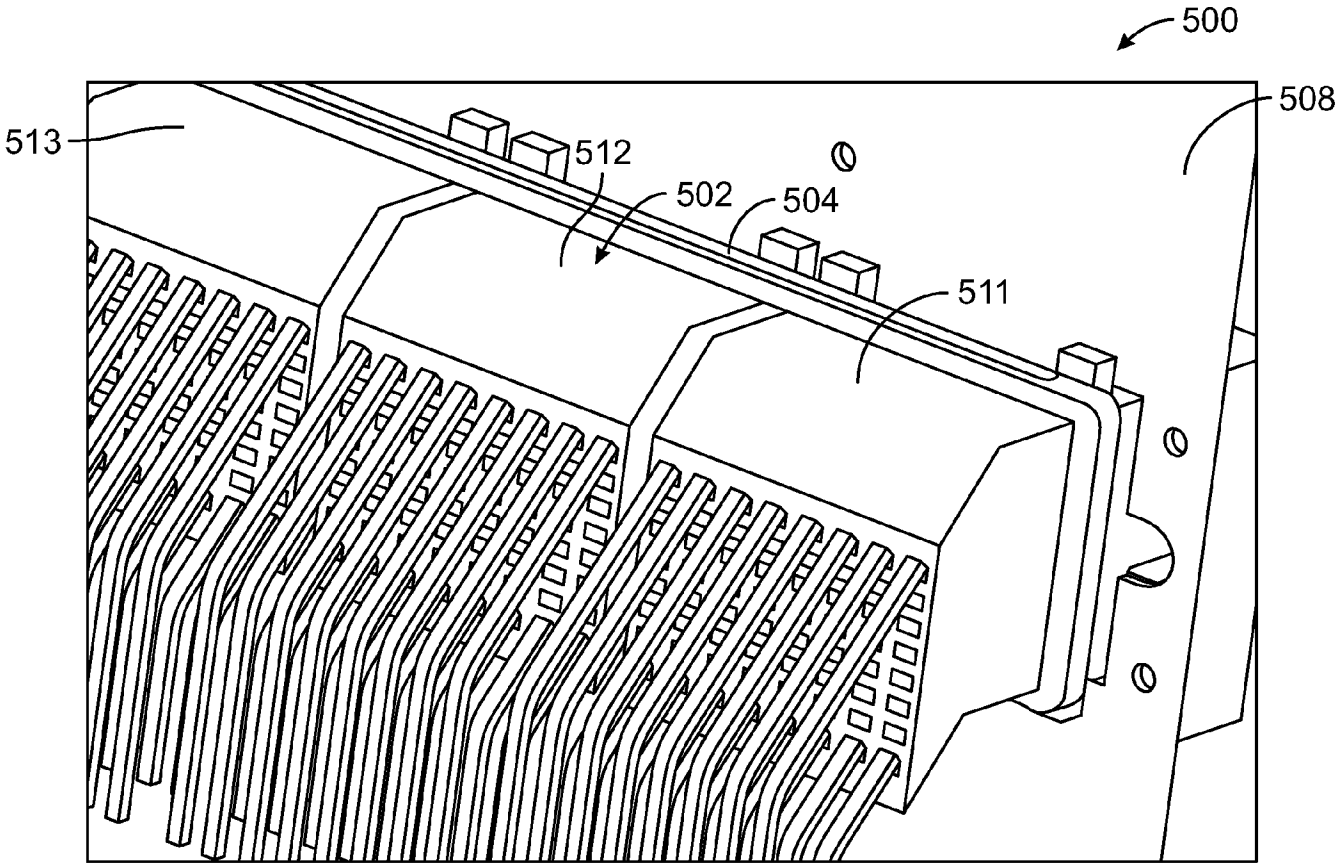
FIG. 10 is a rear perspective view of a connector assembly formed in accordance with one embodiment.

FIG. 10 is a rear perspective view of a connector assembly 500 that includes a module assembly 502 having connector modules 511-513. The connector assembly 500 also includes a coupling member 504 that engages each of the connector modules 511-513. The coupling member 504 joins the connector modules 511-513 to each other. As shown, the connector modules 511-513 may be aligned side-by-side and mounted to a panel 508. The coupling member 504 surrounds an outer periphery of the connector modules 511-513 behind the panel 508.

The coupling member 504 is configured to hold the connector modules 511-513 adjacent to each other as shown in FIG. 10. However, the coupling member 504 may also permit the connector modules 511-513 to move relative to each other. For example, during a mating operation, if an alignment force displaces the connector module 512, the coupling member 504 may permit movement of the connector module 512 relative to the connector modules 511, 513. Once the alignment force is removed, the coupling member 504 may facilitate moving the connector modules 511-513 back to unmated states. The coupling member 504 may permit other types of movement, such as those described above with respect to FIGS. 7-9.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a support frame; and a floatable module assembly movably coupled to the support frame, the module assembly including first and second connector modules positioned adjacent to each other and a coupling member that joins the first and second connector modules, each of the first and second connector modules configured to mate with a corresponding mating connector along a mating axis to establish a communicative connection;

wherein the coupling member joins the first and second connector modules such that the first and second connector modules move with each other and move relative to the support frame, the coupling member permitting the first and second connector modules to move relative to each other as the corresponding mating connectors engage the first and second connector modules.

2. The connector assembly of claim 1, wherein the coupling member is an elastic member that flexes to permit the first and second connector modules to move relative to each other.

3. The connector assembly of claim 2, wherein the coupling member includes a loop that comprises a flexible material, the loop engaging at least a portion of the first connector module and at least a portion of the second connector module.

4. The connector assembly of claim 1, wherein the coupling member has a tension that holds the first and second connector modules adjacent to each other when the first and second connector modules are in unmated positions, the coupling member permitting the first and second connector modules to move relative to each other when alignment forces provided by the mating connectors displace the first and second connector modules.

5. The connector assembly of claim 1, wherein the coupling member permits the first and second connector modules to move away from each other.

6. The connector assembly of claim 1, wherein the coupling member permits at least one of the first or second connector modules to rotate about the corresponding mating axis of said at least one of the first or second connector modules.

7. The connector assembly of claim 1, wherein the coupling member permits the first and second connector modules to be oriented such that the corresponding mating axes extend parallel to each other, the coupling member permitting the first and second connector modules to be oriented such that the corresponding mating axes extend non-parallel to each other.

8. The connector assembly of claim 1, wherein the first and second connector modules are permitted to move freely without resistance by the coupling member up to a designated separation distance between the first and second connector modules, the coupling member resisting further separation beyond the designated separation distance.

9. The connector assembly of claim 1, wherein the module assembly further comprises a third connector module that is positioned adjacent to one of the first or second connector modules, the coupling member joining the third connector module to said at least one of the first or second connector modules.

10. The connector assembly of claim 1, wherein the first and second connector modules have respective connector housings, the connector housings having corresponding interior sides that interface with each other and are permitted to move away from each other or to non-parallel positions with respect to each other.

11. The connector assembly of claim 1, wherein the module assembly includes a plurality of the coupling members.

12. The connector assembly of claim 11, wherein at least two of the coupling members are located on opposite sides of the module assembly.

13. A connector assembly comprising:

a support frame; and a floatable module assembly movably coupled to the support frame, the module assembly including first and second connector modules positioned adjacent to each other and a coupling member that joins the first and second connector modules, each of the first and second connector modules configured to mate with a corresponding mating connector along a mating axis to establish a communicative connection;

wherein the coupling member has a tension that holds the first and second connector modules adjacent to each other when the first and second connector modules are in unmated positions, the coupling member permitting the first and second connector modules to move relative to each other when alignment forces provided by the mating connectors displace the first and second connector modules.

14. The connector assembly of claim 13, wherein the coupling member is an elastic member that flexes to permit the first and second connector modules to move relative to each other.

15. The connector assembly of claim 13, wherein the coupling member permits the first and second connector modules to move away from each other.

16. The connector assembly of claim 13, wherein the coupling member permits at least one of the first or second connector modules to rotate about the corresponding mating axis.

17. The connector assembly of claim 13, wherein the coupling member permits the first and second connector modules to be oriented such that the corresponding mating axes extend parallel to each other, the coupling member permitting the first and second connector modules to be oriented such that the corresponding mating axes extend non-parallel to each other.

18. The connector assembly of claim 13, wherein the first and second connector modules are permitted to move under resistance from the coupling member up to a maximum separation distance between the first and second connector modules, the coupling member restricting further separation beyond the maximum separation distance.

19. The connector assembly of claim 13, wherein the module assembly includes a plurality of the coupling members.

20. The connector assembly of claim 19, wherein at least two of the coupling members are located on opposite sides of the module assembly.

* * * * *